US006915746B2

(12) United States Patent
Coslovi

(10) Patent No.: US 6,915,746 B2
(45) Date of Patent: Jul. 12, 2005

(54) CENTER PLATE ASSEMBLY FOR A RAIL ROAD CAR

(75) Inventor: Ilario A. Coslovi, Burlington (CA)

(73) Assignee: Ronsco Inc.

( * ) Notice: Subject to any disclaimer, the term of this patent is extended or adjusted under 35 U.S.C. 154(b) by 0 days.

(21) Appl. No.: 10/608,218

(22) Filed: Jun. 30, 2003

(65) Prior Publication Data

US 2004/0261653 A1 Dec. 30, 2004

(51) Int. Cl.[7] ..... B61F 5/00
(52) U.S. Cl. ..... 105/199.4; 105/189
(58) Field of Search ..... 105/189, 199.4, 105/226; 384/422

(56) References Cited

U.S. PATENT DOCUMENTS

| | | | | |
|---|---|---|---|---|
| 639,311 | A | * 12/1899 | Street | 384/422 |
| 768,901 | A | * 8/1904 | Hopkins | 105/230 |
| 1,697,028 | A | * 1/1929 | Tangerman | 384/422 |
| 2,078,176 | A | * 4/1937 | Hartwig | 384/422 |
| 2,184,337 | A | 12/1939 | Duryea | |
| 3,664,269 | A | 5/1972 | Fillion | |
| 3,797,674 | A | 3/1974 | Reynolds | |
| 3,831,530 | A | * 8/1974 | Cope et al. | 105/199.4 |
| 4,056,065 | A | 11/1977 | Fiegl et al. | |
| 4,222,331 | A | * 9/1980 | Gage et al. | 105/199.4 |
| 4,252,068 | A | 2/1981 | Nolan | |
| 4,744,308 | A | * 5/1988 | Long et al. | 105/199.4 |
| 4,977,835 | A | * 12/1990 | Altherr | 105/199.4 |
| 5,481,985 | A | * 1/1996 | Lin et al. | 105/199.4 |
| 5,704,296 | A | 1/1998 | Gagliardino et al. | |
| 5,908,001 | A | * 6/1999 | Burke et al. | 105/199.4 |
| 6,138,577 | A | 10/2000 | Dalrymple | |
| 6,324,995 | B1 | 12/2001 | Kaufhold et al. | |

OTHER PUBLICATIONS

Unknown Author, Center Plate Relief, Standard, Alternate Standard, S–258–80, Adopted 1980, Association of American Railroads Mechanical Division: Manual of Standards and Recommended Practices, Jan. 1, 1984, C–24.

Unknown Author, Cast Steel or Forged Body Center Plate for Freight Cars with Standard 6 1/2" × 12" Journals, Alternate Standard 6" × 11" Journals, Standard S–207–79, Adopted 1970, Revised 1976, 1978, Association of American Railroads Mechanical Division: Manual of Standards and Recommended Practices, Jul. 01, 1982, C–26.

* cited by examiner

*Primary Examiner*—Mark T. Le
(74) *Attorney, Agent, or Firm*—McCarthy Tetrault LLP

(57) ABSTRACT

A railroad car body has a longitudinally extending center sill, and a main bolster extending transversely relative to the center sill. A center plate is mounted under the center sill at the intersection of the center sill and the main bolster. The center plate seats in the center plate bowl of a truck that supports the rail road car body for rolling motion along the rail road tracks. The center plate is a casting that has a round peripheral wall that seats entirely within the center plate bowl. None of the center plate extends beyond the round peripheral wall, and none of the center plate overhangs the peripheral upstanding steel ring of the center plate bowl wall. The center plate has a continuous circumferential welding fillet relief such as may tend more easily to permit automated welding. The center plate has a hollow, upstanding truncated central cone member for accommodating a king pin. The truncated cone stands taller than the rim. A keying fitting is mounted adjacent to the central cone to discourage angular mis-orientation of the lateral center plate edge reliefs.

20 Claims, 10 Drawing Sheets

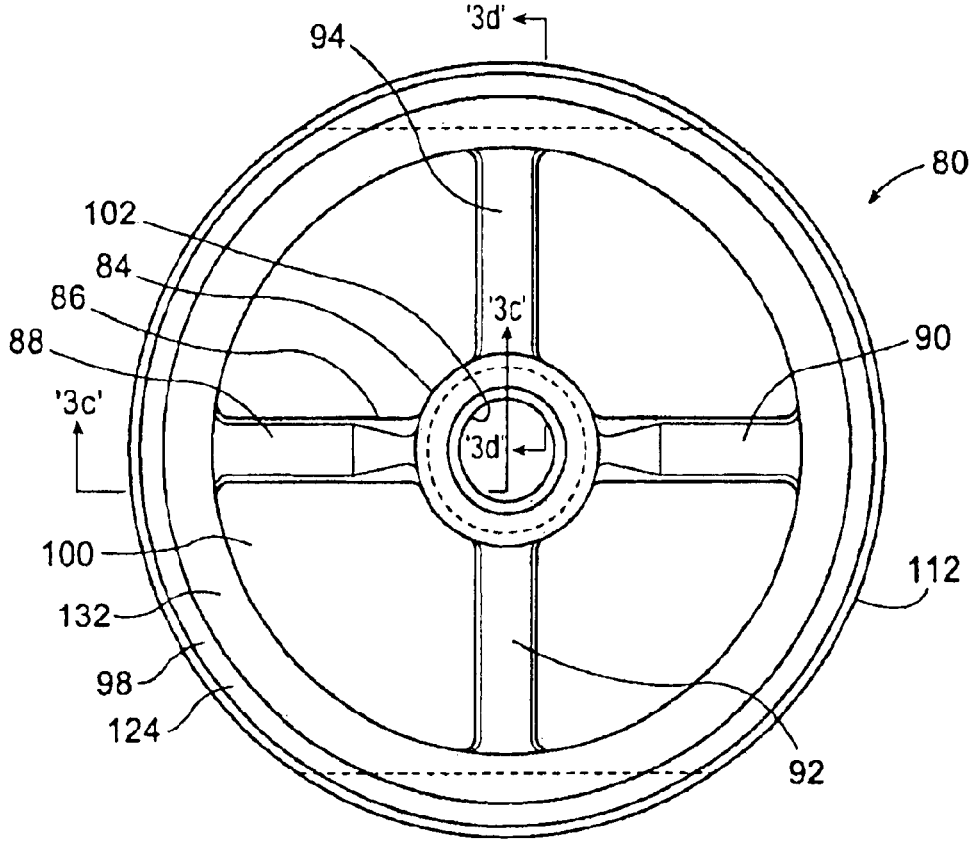
Figure 3b
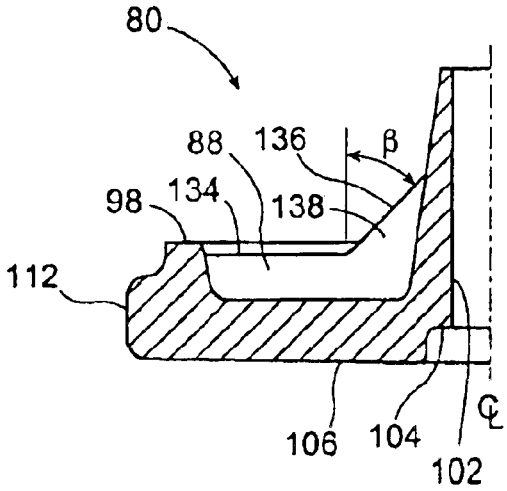
Figure '3c'
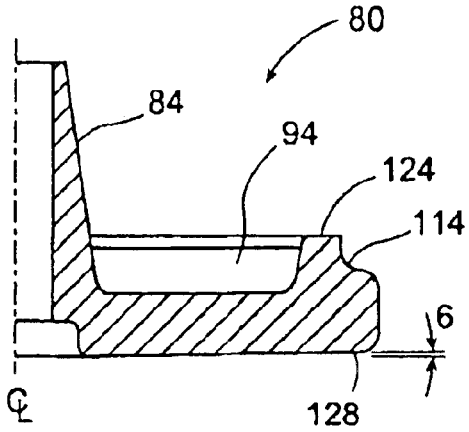
Figure '3d'

CENTER PLATE ASSEMBLY FOR A RAIL ROAD CAR

FIELD OF INVENTION

This invention relates generally to center plates and center plate installations in rail road cars.

BACKGROUND OF THE INVENTION

In rail road freight cars in North America, the weight of the car body is borne along the tracks by rail road car trucks. The load path by which the vertical load of the car body is passed into the truck is through the body center plate. The body center plate is mounted to the rail road car body, and a mating center plate bowl is defined on the truck bolster.

The center plate bowl has the shape, in general, of a bowl. The periphery of the bowl is defined by a centrally positioned circular steel ring that stands upwardly from the upper flange of the truck bolster. It forms a cup, or hollow, inside and is sometimes provided with a liner, which may be made of a high density polymer.

The body center plate has the form of a large, downwardly protruding circular boss that seats in the bowl, on top of the liner if a liner is provided. The weight of the car is passed through the body center plate boss and into the top flange of the truck bolster. The nested relationship of the body center plate boss and the peripheral steel ring of the center plate bowl is such that the truck bolster, and hence the truck more generally, can pivot about the vertical axis of the center plate boss, thus allowing the rail car to pass over curved track.

Both the body center plate and the center plate bowl have circular central apertures that align and admit a king pin. The king pin seats in the center of the truck bolster, and the boss is located on the pin, the king pin acting as a pivot pin, or hinge pin, about whose axis the pivoting motion of the truck bolster occurs relative to the car body. In some instances, although the pin is free to rotate about its vertical axis, the pin is locked in place vertically, such that if the rail car derails, the truck may be prevented from escaping from the rail car body.

Using FIG. 1*b* as a guide and recognizing that FIG. 1*b* is not prior art, but rather an illustration provided by the present inventor for the purpose of explaining nomenclature, rail road freight cars A20 most typically have either a straight-through center sill running the full length of the car from end to end, (as may be typical in a flat car, a spine car, or a center beam car, for example) or stub center sills at either end of the car (as in gondola cars or flow-through cars such as hopper cars, pellet cars, grain cars, and so on). In each case the center sill A22 has a top flange A24 and a pair of parallel, spaced apart, downwardly extending webs A26, A28, and may have a bottom flange A30, such that a boxed hollow section is formed. In a relatively common style of center sill, a pair of Z-sections were welded together to form a hat section, with the top of the hat forming the top flange of the center sill, and the lower legs of the Z-sections forming a pair of bottom flanges on the opposed vertical webs of the center sill. Draft pockets are defined at the ends of the center sill. Draft gear and couplers are mounted in the draft pockets. Most typically, the height of the center sill tends very strongly to be a function of the allowable height of the center of the coupler, that maximum height being 34½ inches above top of rail (TOR). Since the end portions of the center sills are made to fit standard AAR coupler sizes, the center sill width between the downwardly extending flanges is generally 12⅞" (+⅛"/−0"). The depth of the center sill is similarly generally such as to admit a coupler having a height above the coupler center line of 6$^{11}/_{32}$(+/−) inches and a height below the coupler centerline of about 6⅛(+/−) inches to the outer face of the bottom flanges where the bottom flange cover plate of the draft pocket is bolted in place to retain the draft gear. Illustrations of these elements are shown at pages 652 and 653 of the 1997 Car & Locomotive Cyclopedia.

The central circular boss A36 of the body center plate A32 is usually mounted to the center sill of a rail road car at the longitudinal station of the body bolster. The body bolster, sometimes referred to as the main bolster A34, is the main laterally extending structural member of the underframe of the railroad car. Body bolsters carry vertical loads from the side sills into the center sill. Most typically, the main bolster intersects the center sill at the longitudinal station of the truck center, such that the main vertical load is passed into the center sill directly above the point of vertical reaction, namely the center plate bowl A38 on the truck bolster A40. The main bolster typically has the form of an irregularly shaped hollow cantilever beam of generally deep section at the center sill, and shallower section at the side sills. The main bolster typically has a top flange A42 that is coincident with the deck (in a flat car) or shear plate (in a grain, hopper, or pellet car), and a kinked bottom flange A44 that has a relatively deep laterally inboard portion, to which a side bearing is mounted, and a shallow outboard portion, the diminution of section being intended to clear the sideframes of the truck A46. The respective bottom flanges A44 of the left and right hand arms of the main bolster A34 most typically abut the outboard edge of the bottom flange of the center sill, such that compressive loads in the bottom flange of the main bolster are passed into the bottom flange of the center sill. A pair of spaced apart, parallel vertical webs extend between the top and bottom flanges of the main bolster, and carry vertical shear from the side sills and deck into the center sill. These webs are spaced 12 inches apart.

It is desirable to have web continuity between the webs of the left hand arm of the main bolster, and the webs of the right hand arm. This may be done, as described in the present invention herein, by providing separator plates in the nature of internal gussets, or webs, inside the main sill. It is advantageous to align those webs with the bolster webs.

In some instances, the center sill has a center sill cover plate, or bottom bolster tie plate A50, that extends between the webs of the center sill. The tie plate may have flanges, or tabs, that protrude laterally beyond the webs of the center sill. These tabs, or flanges, may be bent upwardly to give slope continuity with the bottom flanges of the left and right hand arms of the main bolster, which they meet in mating abutment.

There are at least two ways of mounting the boss of the body center plate to the rail road car body. In a generally somewhat older style of installation, the center plate assembly included a generally square, or rectangular, base plate A32 and the circular boss A36. The base plate had four corner flanges by which it was bolted to the outboard bottom flanges A30 of the center sill A22. In this style of car, a collar in the nature of a round central tube A62 was mounted inside the center sill A22 to accommodate the king pin A64, the central tube being supported in place by 4 gussets A66 on 90 degree centers: two extending along the longitudinal centerline of the car to terminate at internal separator plates inside the center sill; and two extending laterally in the direction of the main bolster centerline to meet with the webs of the center sill. This assembly was referred to as a built-in center filler. The center filler also included a bottom plate, namely tie plate A50 to which the collar and the four upstanding gusset plates were welded. The bottom plate was installed inside the center sill, flush with the bottom flanges of the center sill. This style of construction may tend to be relatively expensive to fabricate, and may be prone to cracking at the bolts and at the gussets.

Increasing car weight, and dissatisfaction with the above described style of center plate may have been factors leading to the development, in about 1975, of a different style of center plate, in the form of a center plate casting rather than a fabricated center filler assembly. In this type of casting, the collar for the king pin is integrally cast with the bearing portion of the center plate assembly. An example of this style of center plate casting is illustrated in U.S. Pat. No. 4,744,308 of Long et al., issued May 17, 1988. In this style of center plate casting, there is a boss, being the actual center plate bearing portion, and a center filler portion. The center filler portion includes a square, upstanding peripheral wall, and four integrally cast webs that join the peripheral wall to the collar and bearing portion. The peripheral wall is tapered to fit inside the four sided opening defined between the internal cross-gussets, namely the center sill web separators, and the webs of the center sill. At the base of the external, tapered face of the wall is a generally four sided shoulder. The vertices of the four sided shoulder meet at outwardly protruding lugs that have upwardly facing pads. The bottom flange of the center sill has a big, four sided hole to accommodate the center plate center filler. When the center plate casting is installed, the center filler is inserted in the big four sided hole, and the pads abut the underside of the center sill beneath the vertical webs. The center plate casting is then welded in place along the filler sides.

The present inventor has made a number of observations concerning this newer style of center plate casting. First, by being more or less square, the casting may require that the internal web separators of the center sill be spaced to give an inside clearance between them of 12⅞ inches (+⅛"/−0"). This means that the cross-gussets (i.e., the center sill web separators) may tend not to be aligned with the webs of the main bolster that are 12" apart. In the view of the present inventor, it would be advantageous to employ a center plate assembly that would permit the cross-gussets to provide directly aligned web continuity for the webs of the main bolster through the center sill.

Second, by being more-or-less square, it may be possible to insert the center plate assembly incorrectly such that the relieved side margins of the bearing portion of the center-plate are oriented front-to-back along the center sill, instead of side-to-side. In the view of the present inventor, it would be advantageous to employ a center plate casting that is keyed to prevent mis-orientation of the casting upon installation.

Third, the four corner lugs may tend to extend radially outward from the king pin axis a distance greater than the outer wall radius of the center plate boss and a distance greater then the inner wall radius of the center plate bowl of the truck bolster. As such they may tend to overhang the peripheral wall of the center plate bowl. Since they overhang the ring, the bottom flange of the center sill must be carried higher than it might otherwise be, by a height increment corresponding to the thickness of the lug. This in turn may tend to raise the coupler centerline height, possibly undesirably far. In the view of the present inventor it would be advantageous to employ a center plate casting that is free of elements, such as the above noted lugs, that overhang the peripheral ring of the center plate bowl.

Fourth, the upwardly protruding portion of the integrally cast center plate filler has a taper, first to facilitate molding, second to facilitate installation in the generally square hole in the bottom plate of the center sill. However, given that the tolerance on the center sill must be+x/−0, (because otherwise the hole may be too small for the casting) and that the tolerance on the casting must be+0/−x, (because otherwise the casting may be too big for the hole) there is a tendency for the upwardly extending tapered wall of the cast center filler not to seat tightly against the webs and gussets of the center sill. That is to say, when the tolerances on both parts have to be to opposite sides of the desired dimension, there will be a tendency for the tolerance build up to result in a gap between the parts. Consequently, when the casting is welded along the reliefs of the rectangular shoulder, there is a tendency for the weld to blow through the gap. This may be highly undesirable from a manufacturing viewpoint. Further still, the square design with the lugs may tend to require a stop-and-start style of welding along four chamfered reliefs. The present inventor has observed that this style of welding may tend to result in poor welds more often than perhaps might otherwise be the case. In the view of the present inventor, it may be advantageous to employ a continuous circumferential weld, rather than the stop-and-start style.

Fifth, the integral center plate casting necessitates the existence of a big, relatively sharp-cornered square hole in the bottom flange of the center sill, directly opposite the juncture of the bottom flanges of the main bolster with the center sill bottom flange. This large square hole may have tended to weaken the center filler area of the car, by removing the center sill bottom cover plate in the area, and it may tend to interrupt, or interfere with load transfer in the surrounding structure. It would be advantageous not to require this large, badly shaped (i.e, with squared, fairly sharp corners) hole, but rather to employ a plate to provide a large measure of flange continuity across the center sill.

Sixth, the presently used plug type center plates require a relatively significant amount of surface preparation adjacent to the opening in the center sill. It would be advantageous to employ a center plate that requires less work to prepare.

SUMMARY OF THE INVENTION

In an aspect of the invention there is a center plate assembly for attachment to a center sill, the center plate having a bearing surface for seating inside a center plate bowl of a rail road car truck, wherein the attachment interface of the center plate lies fully within the vertical projection of the circumference of the inner surface of the center plate bowl.

In another aspect of the invention, there is a center plate assembly for attachment to the center sill of a railroad car, wherein the center plate is free of attachment lugs. In still another aspect of the invention, there is a combination of a railroad car and a center plate, wherein the railroad car has a center sill and a main bolster mounted transversely relative to that center sill, the center sill having web separators mounted therewithin to provide aligned web continuity through the center sill, the web separators and the webs of the center sill defining a four sided space, and the center plate assembly being mounted concentrically with the centroid of the four sided space. In another feature of that aspect of the invention, the four sided space has a center filler assembly mounted therein, the center filler assembly and the center plate being concentric.

In another aspect of the invention, there is a center plate for a railroad car. The center plate has an upwardly oriented mounting interface for rigid connection to the railroad car. A radially outermost portion is seatable within a center plate bowl of the railroad car truck. A downwardly facing bearing surface mountable is in pivotable engagement within the center plate bowl, and an integrally formed central portion for accommodating a king pin. The central portion stands taller than the mounting interface.

In another feature, the center plate is a monolith. In a further feature, the center plate is a casting. In still another feature, the radially outermost portion is an upstanding peripheral wall. In another feature, the upstanding peripheral wall is circular. In still yet another feature, a welding relief is formed radially outwardly adjacent to the abutment face. In a further feature, a welding relief is formed radially outwardly adjacent to the abutment face. In still a further feature, the center plate has an upwardly oriented indexing member operable to discourage mis-orientation of the center plate relative to the railroad car.

In yet a further feature, the center plate has a base plate. The bearing surface is a surface of the base plate. There is a circular peripheral wall. The radially outermost portion is a radially outwardly oriented portion of the circular peripheral wall. The circular peripheral wall extends upwardly of the base plate. At least one web stands upwardly of the base plate and extends between the central portion and the circular peripheral wall. The indexing member is a super-elevated portion of the web.

In another aspect of the invention, there is a center plate casting for a railroad car. The casting has a radially outermost portion surrounding the bearing surface. The radially outermost portion is seatable entirely radially within a center plate bowl of a railcar truck. The radially outermost portion has an upwardly oriented abutment for rigid connection to the railroad car, a bearing surface for placement upon a railcar truck and a hollow central portion standing taller than the abutment.

In yet another aspect of the invention, there is a center plate casting for a railroad car. The center plate casting has a bearing portion for seating in pivotally movable engagement within a center plate bowl of a railroad car truck. There is an interface for rigidly mounting to a railroad car and a radially outermost portion seatable within a center plate bowl. A hollow central portion stands taller than, and radially inward of, the interface and the casting is free of any member extending a radially greater distance than the radially outwardly located portion.

In still another aspect of the invention, there is a center plate for a rail road freight car. The center plate is for installation between a central sill member of the rail road car and a center plate bowl of a railroad car truck. The center plate comprises a base portion having a bearing surface pivotally engageable in the center plate bowl of the truck. A peripheral wall extends upwardly of the bearing surface. The wall has an attachment interface for rigid mounting of the center plate to the central sill member of the railroad car. A central hollow member stands upwardly of the base portion. The hollow member is taller than the peripheral wall. The hollow member has a passage defined therein to accommodate a railroad car king pin. The center plate is free of any member extending radially beyond the peripheral wall.

In another feature of that aspect of the invention, the center plate has at least one indexing member engageable with the central sill member to establish angular orientation of the center plate relative to the central sill member.

In another feature, the peripheral wall has a welding relief extending thereabout adjacent to the attachment interface. In still another feature, upstanding web members extend between the central hollow member and the peripheral wall. In yet another feature, upstanding web members extend between the central hollow member and the peripheral wall. The indexing member is a super-elevated portion of one of the web members. In still yet another feature, the center plate is a monolith. In a further feature, the center plate is a casting. In still a further feature, the peripheral wall is a circular wall extending about the base portion.

In another aspect of the invention, there is the combination of a railroad car and a railroad car truck therefore wherein the railroad car has a center plate mounted thereto. The truck has a center plate bowl into which the center plate seats in pivotally moveable engagement. The center plate has a connection portion by which it is rigidly attached to the railroad car. The center plate has a radially inward portion. The radially inward portion stands taller than the connection portion. The center plate is free of any portion overhanging the center plate bowl.

BRIEF DESCRIPTION OF THE DRAWINGS

For a better understanding of the present invention and to show more clearly how it may be carried into effect, reference will now be made by way of example, and not of limitation, to the accompanying drawings, which show apparatus according to aspects of the principles of the present invention and in which:

FIG. 3*b* shows a top view of the center plate of FIG. 3*a;*

FIG. 3*c* shows a partial section of the center plate of FIG. 3*a* on '3*c*—3*c*';

FIG. 3*d* shows a partial section on '3*d*—3*d*', being perpendicular to the partial section of FIG. 3*c*, of the center plate of FIG. 3*a;*

DETAILED DESCRIPTION OF THE PREFERRED EMBODIMENT

Figure 1A:
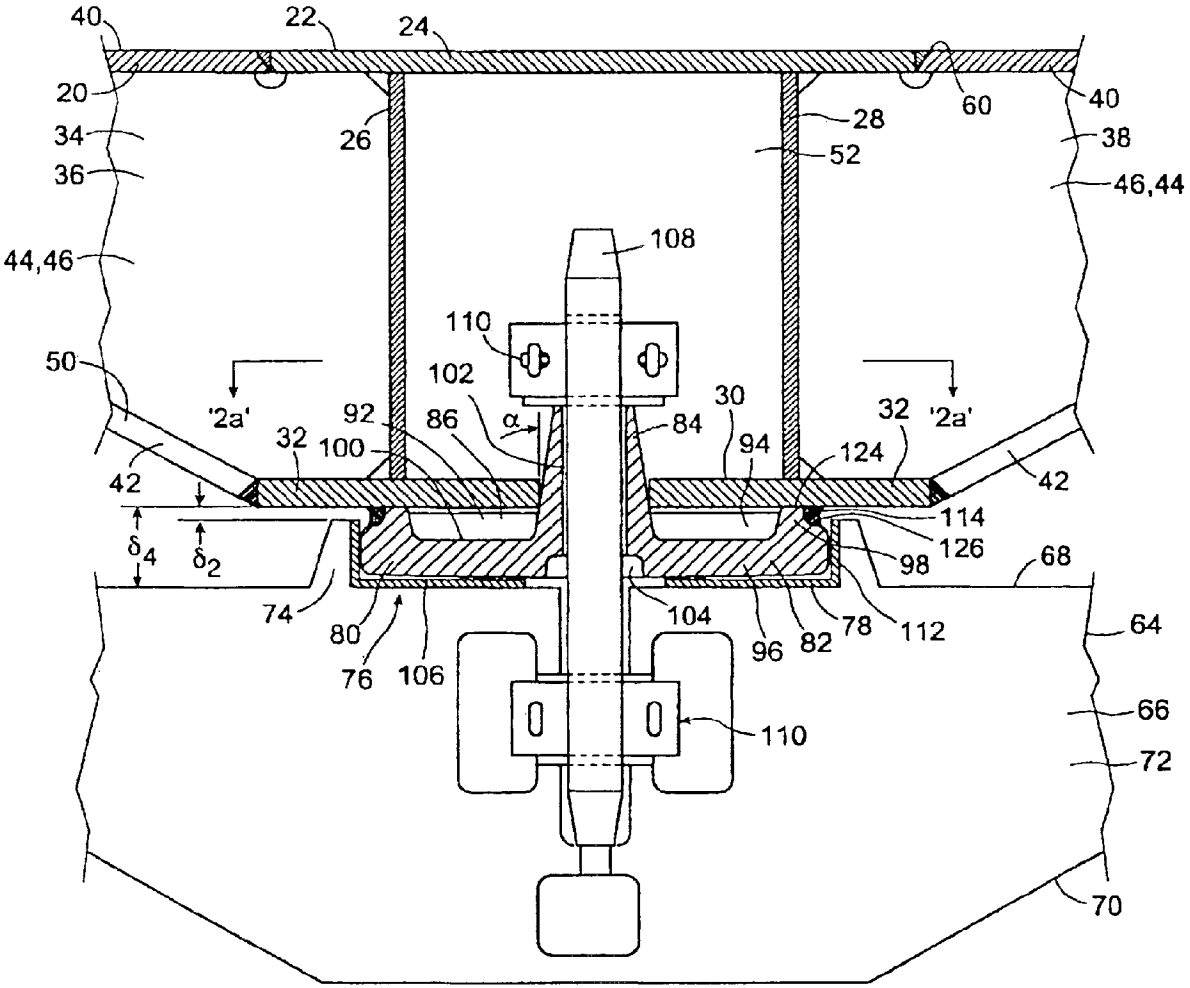
FIG. 1*a* shows a cross section of a railroad freight car taken at the longitudinal station of the main bolster, showing the center sill, the main bolster, the truck bolster, the center plate bowl, and the body center plate according to the principles of the present invention.

The description that follows, and the embodiments described therein, are provided by way of illustration of an example, or examples of particular embodiments of the principles of the present invention. These examples are provided for the purposes of explanation, and not of limitation, of those principles and of the invention. In the description which follows, like parts are marked throughout the specification and the drawings with the same respective reference numerals. The drawings are not necessarily to scale and in some instances proportions may have been exaggerated in order more clearly to depict certain features of the invention.

In terms of general orientation and directional nomenclature, for each of the rail road cars described herein, the longitudinal direction is defined as being coincident with the rolling direction of the car, or car unit, when located on tangent (that is, straight) track. In the case of a car having a center sill, whether a through center sill or stub sill, the longitudinal direction is parallel to the center sill, and parallel to the side sills, if any. Unless otherwise noted, vertical, or upward and downward, are terms that use top of rail TOR as a datum. The term lateral, or laterally outboard, refers to a distance or orientation extending cross-wise relative to the longitudinal centerline of the railroad car, or car unit, indicated as CL-Rail Car. The term "longitudinally inboard", or "longitudinally outboard" is a distance or orientation relative to a mid-span lateral section of the car, or car unit.

FIG. 1*a* shows a section of a rail road freight car, 20, taken at the longitudinal station of one of its truck centers. For the purposes of this description, unless otherwise noted, the illustrated elements of freight car 20 are symmetrical about a vertical plane passing through the longitudinal centreline of the car, that plane also passing through the truck centers. Freight car 20 has a center sill 22 that has a top flange, 24, a pair of left and right hand spaced apart, parallel vertical webs 26, 28, and a pair of left and right hand, generally co-planar, horizontal flanges 32 that extend laterally horizontally outboard from the lowermost longitudinal margins of webs 26, 28. Freight car 20 also has a center sill bottom tie plate, or cover plate 30, mounted, by welding, between the lower margins of webs 26, 28 flush with flanges 32.

A body bolster, identified as main bolster 34, meets center sill 22 at the truck center. In this description, main bolster 34 can be taken as being symmetrical about not only the longitudinal central vertical plane of rail car 20, but also about a transverse vertical plane coincident with the truck center, perpendicular to the longitudinal vertical central plane of symmetry. Main bolster 34 has left and right hand arms 36, 38. Each of arms 36 and 38 has a top flange 40, a bottom flange 42, and a pair of spaced apart vertical webs 44, 46 that extend between top flange 40 and bottom flange 42 to form a closed hollow cantilever beam. The depth of the beam is greatest at the center sill, and diminishes to a shallower section at its distal end at the side sill (not shown). Bottom flange 42 has two portions, namely an upwardly and outwardly inclined inner portion 50 abutting the laterally outboard margin of the center sill bottom flange 32; and a transversely outermost, generally horizontal portion (not shown). Portion 50 also has a side bearing mounted to it to engage the side bearing the underlying truck bolster. A pair of parallel, internal cross-gussets 52, 54 are mounted within center sill 22 in the planes of the webs of main bolster 34 to give web continuity to webs 44, 46 across center sill 22.

Freight car 20 has a lading supporting structure of some type supported by center sill 22 and main bolster 34, that lading supporting structure being generically symbolized by structure indicated as 60, which may be a flat car or box car deck, 62, a center beam assembly, a hopper car end structure, a well car end structure, and so on.

Rail road car 20 is mounted on rail road car trucks 64 for rolling motion in the longitudinal direction. Truck 64 is a three-piece rail road freight car truck, and may be a 70 Ton, 100 Ton, 110 Ton, or 125 Ton truck, according to AAR terminology, and may be a conventional truck such as a Barber S2 truck, or a Ridemaster (t.m.) truck, a 70 ton special autorack truck, or a swing motion truck. In each case truck 64 has a truck bolster 66. Truck bolster 66 is typically a casting. Truck bolster 66 has an upper flange 68, a lower flange 70, and webs 72 extending between flanges 68 and 70. A centrally located, upwardly extending integrally cast steel ring 74 co-operates with upper flange 68 to define a center plate bowl, indicated generally as 76, for receiving the bearing portion of a body center plate. Bowl 76 may have an internal liner 78, (of stainless steel or of manganese), to reduce friction between the center plate and bowl 76.

A center plate is indicated generally as 80. Although a monolithic part like casting 80 could be made as a forging, as a part machined from solid, it is preferred that center plate 80 be a casting with a machined bearing surface, a machined abutment surface and a machined outer wall surface. Center plate casting 80 has a bearing portion, indicated generally as 82, an upstanding, integrally cast central hollow truncated cone 84, and an array 86 of radially extending upwardly standing ribs, or webs, 88, 90, 92, 94. Bearing portion 82 has the general shape of a bowl, with a flat, circular disc plate portion 96 having an upstanding circular peripheral wall, or rim 98. Disc plate portion 96 is of a size for mating with bowl 76. For a 100 Ton truck, disc plate portion 96 may have a nominal "16 inch size", namely 15⅞ inches with a tolerance of plus 0 inches, and minus ⅛ inches, such that it can seat within a nominal "16 inch" bowl and anti-wear liner, such as liner 78. For a 110 or 125 Ton truck, disc plate portion 96 could be larger, for a 70 Ton, or 70 Ton "Special" truck, disc plate portion 96 could be smaller, such as, nominally, 14 inches rather than 16 (nominal) inches.

Truncated cone 84 is located centrally with respect to bearing disc plate portion 96, and stands upwardly of inner face 100 thereof. Truncated cone 84 has a taper angle, indicated as a, and has a counter-sunk central through bore, indicated as 102, the counter sink 104 being let into the bearing face 106. Most typically bore 102 has a diameter of 2⅛ inches (+/−1/16 inches) to accommodate a pivot axis defining member in the nature of a ⅛ inches (+/−1/16") king pin 108, that may be provided with locking pins 110 to discourage the escape of truck 64 in the event of a derailment, the washer of king pin 108 seating on the upwardly facing, generally flat truncated end of truncated cone 84.

Circular peripheral rim 98 forms a circumferential flange on base plate portion 96. It will be noted that there is a smooth radius at the lower edge of rim 98, and that rim 98 has a circular cylindrical, radially outwardly facing wall portion 112 that extends upwardly from the radiused bottom corner. Wall portion 112 does not, however, extend to the full height of rim 98, but rather, terminates at an upper chamfered corner at inwardly relieved welding rebate 114 that is shown with a weld fillet in FIG. 1*a*. As shown in FIG. 3*e*, welding rebate 114 has a chamfered portion 116, that terminates at a relatively sharp edge, or circular vertex 118, a sloped portion 120 extending radially inwardly and axially upwardly from vertex 118, and a radiused portion 122 that terminates at a center sill interface in the nature of the top face of rim 98, namely the horizontally flat annular abutment face 124 that lies in a plane parallel to the plane of outward surface, i.e., bearing surface 106, of disc plate portion 96. It may be noted that truncated cone 84 stand significantly taller than rim 98, such that, when center plate 80 is mounted to a rail road car center sill, with rim 98 abutting the underside of the center sill bottom cover plate 30, truncated cone 84 protrudes above the height of face 124 and into the envelope of the center sill.

When center plate 80 is mounted to the overlying center sill assembly of the rail road freight car body, more generally, a bevel weld 126 is formed in the circumferential relief defined by welding rebate 114. In welding, a continuous circumferential pass may be laid down, rather than having to stop and re-start. Further, the sharp edge of circular vertex 118 acts as a boundary point, or boundary edge to guide the welder. That is, the welder knows that the weld is to lie radially inward of sharp edge 118. In this way, the juncture, or interface, at which center plate 80 is joined to the center sill assembly more generally, may tend to lie fully radially inside the outer radius dimension of outwardly facing wall portion 112, that radius dimension being the radially extreme dimension of center plate 80. That is, as illustrated in FIG. 3*e*, the radially outermost edge of the weldment lies roughly equal to or shy of the vertical projection of wall portion 112. As such, the entire attachment interface lies inside the inner wall radius of the bowl 76 and liner 78 of truck bolster 66. Put alternately, body center plate 80 is free of features that overhang the circular circumferential truck bolster wall, namely steel ring 74, of bowl 76.

Figure 1B:
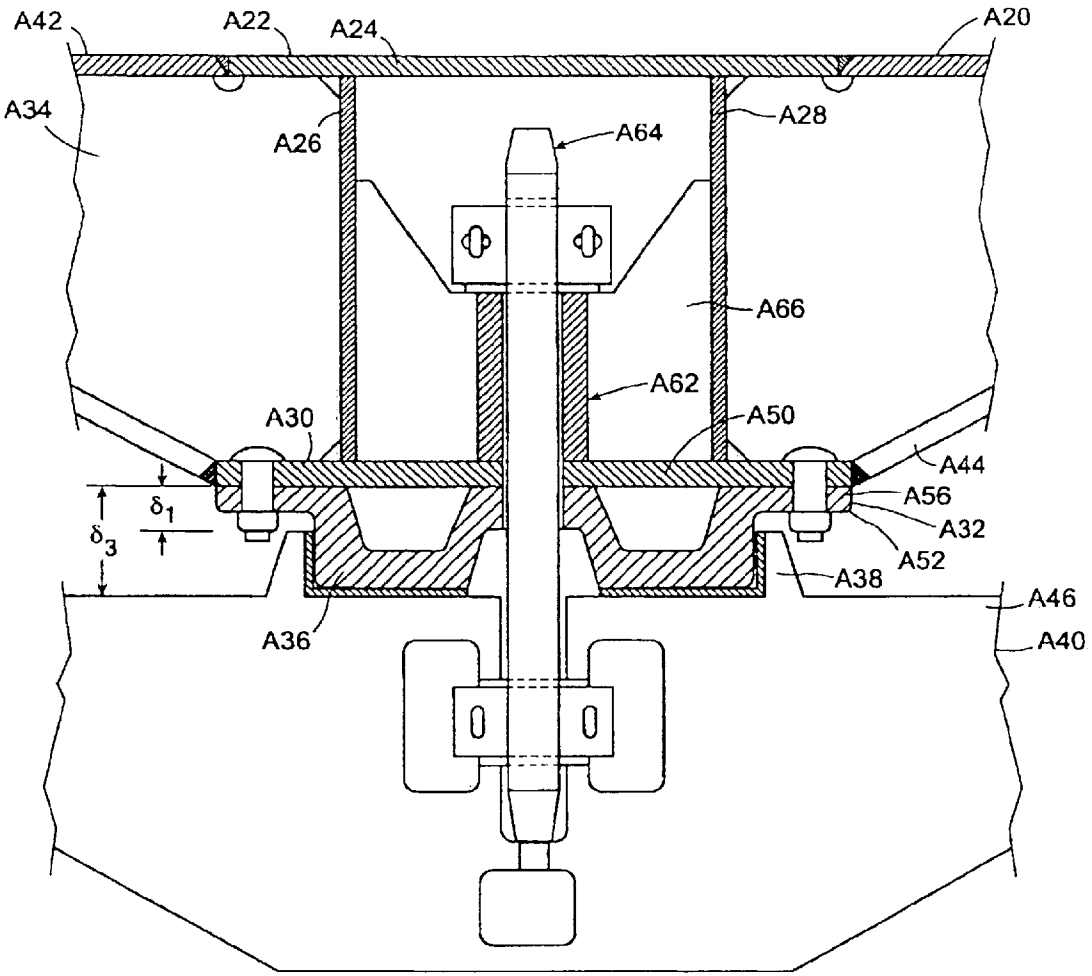
FIG. 1*b* shows a cross-section of a rail road freight car similar to the cross-section of FIG. 1*a*, but showing a number or prior art features.

This in turn may tend to permit center plate 80 to be shallower than otherwise, since it does not have, for example, the generally square base plate of the former style of bolted-in-place center plate of FIG. 1*b*, or the overhanging mounting flanges of the square "plug" style of casting shown, for example, in U.S. Pat. No. 4,744,308. Inasmuch as the minimum vertical clearance between the center plate bowl and the car body structure is measured from the top of the circumferential wall of center plate bowl 76 defined by steel ring 74, and given that there is no overhanging center plate feature, the nearest structure above the center plate bowl is the center sill bottom cover plate 30, (i.e., bottom flange 32. This distance is indicated as $\delta_2$, in contradistinction to the corresponding distance to the center sill bottom cover plate 30 shown as $\delta_1$ in FIG. 1*b*.

This is a desirable feature as it may tend to permit the entire car body, and any lading it may carry, to be lowered by the amount of the height savings, and by so doing may also tend to reduce the incidence of high couplers (i.e., couplers whose centreline height exceeds the 34½" vertical maximum from TOR). A reduction in car body height, and therefore center of gravity, may tend to be directly beneficial in improved L/V ratio, improved track worthiness, and improved ride quality. That is, the height of the underside face of the top flange of the center sill tends to define the upper boundary of the draft pocket in many freight cars. More generally, since the draft gear is rigidly mounted to the center sill, any lowering of the center sill may tend to reduce the height of the coupler centreline, whether the draft pocket cap plate is the top flange of the center sill or not.

This can be expressed in a variety of ways. First, it may tend to permit a reduction in the overall distance between the upper surface of the top flange 68 of the truck bolster 66 to the underside of the bottom flange 32 of the center sill 22, identified as $\delta_4$ in contradistinction to 63 in FIG. 1*b*, or an analogous distance for the square plug style of center plate installation. By way of example, in one embodiment employing a square plug, the distance corresponding to $\delta_3$ may be in the range of 3⁵⁄₁₆ inches to 3⁹⁄₁₆ inches. In the embodiment illustrated in FIG. 1*a*, 84 may be less than 3⁵⁄₁₆ inches (indeed, less than 3 inches), and may lie in the range of in the range of 2⅜ inches to 2⅝ inches, being fully less than 2¾ inches. In sum, the potential reduction in height may be as much as 1³⁄₁₆ inches. A 1" decrease in this height may be considered a comparatively large amount.

Returning to consideration of the Figures, disc plate portion 96 of center plate casting 80 is relieved along laterally outboard portions thereof to allow for rocking of the car body onto the side bearings. The reliefs are indicated as 128, and may be in the form of a 3 degree chamfer commencing from a chord ⅜" laterally inboard or as a ¼" deep step commencing 1⅜" laterally inboard, both according to AAR alternate standard S-258-80 adopted 1980, such as may be applicable to all nominally 14" or 16" diameter center plates.

Center plate 80 has array 86 of upstanding webs 88, 90, 92, and 94 as noted above. These webs are integrally cast, and extend between cone 84 and the upwardly and outwardly tapered, generally inwardly facing inclined annular inner face 124 of rim 98. Webs 88 and 90, in the 12 o'clock and 6 o'clock positions (that is, lying along the longitudinal centreline of the center sill) have a radially distal horizontal vertex portion 134 that extends radially inward at a height that is shy of face 124 of rim 98; and a radially proximal ascending upper vertex portion 136 that is inclined at an angle A, such that it intersects the radially outwardly facing conically tapered outer surface of cone 82 at a level vertically proud of the upper extremity of rim 98, namely proud of annular planar horizontal flat face 124. As will be explained below, this super-elevated portion 138 of web 88 (or 90) acts as an engagement fitting, or male keying fitting to prevent angular mis-orientation of center plate 80. By contrast, webs 92 and 94 have horizontal upper edges, extending generally parallel to the bearing face of center plate 80.

Figure 2A:
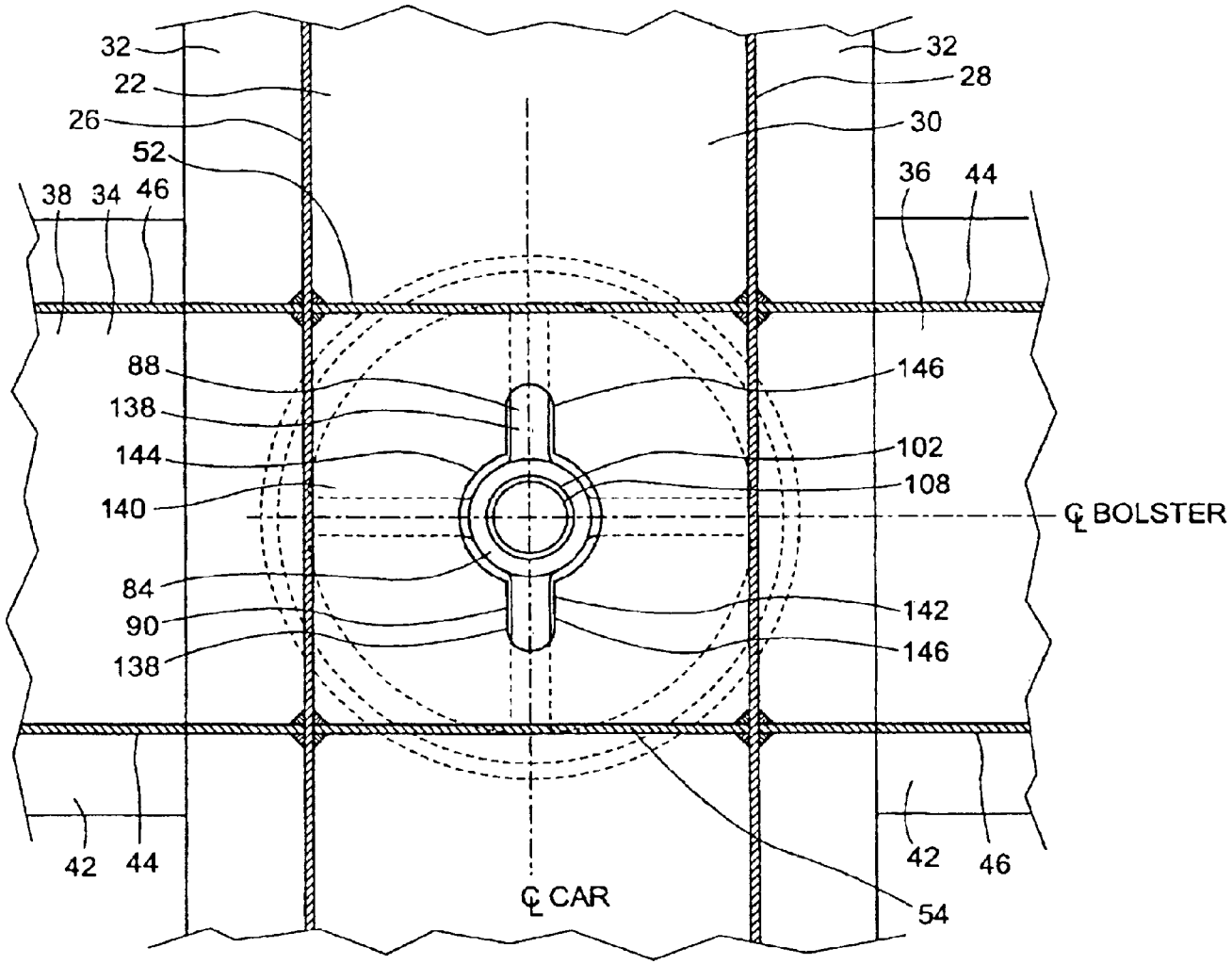
FIG. 2*a* shows a vertical sectional view of the freight car of FIG. 1*a* taken above the truck center on section '2*a*—2*a*' of FIG. 1*a;*
Figure 2B:
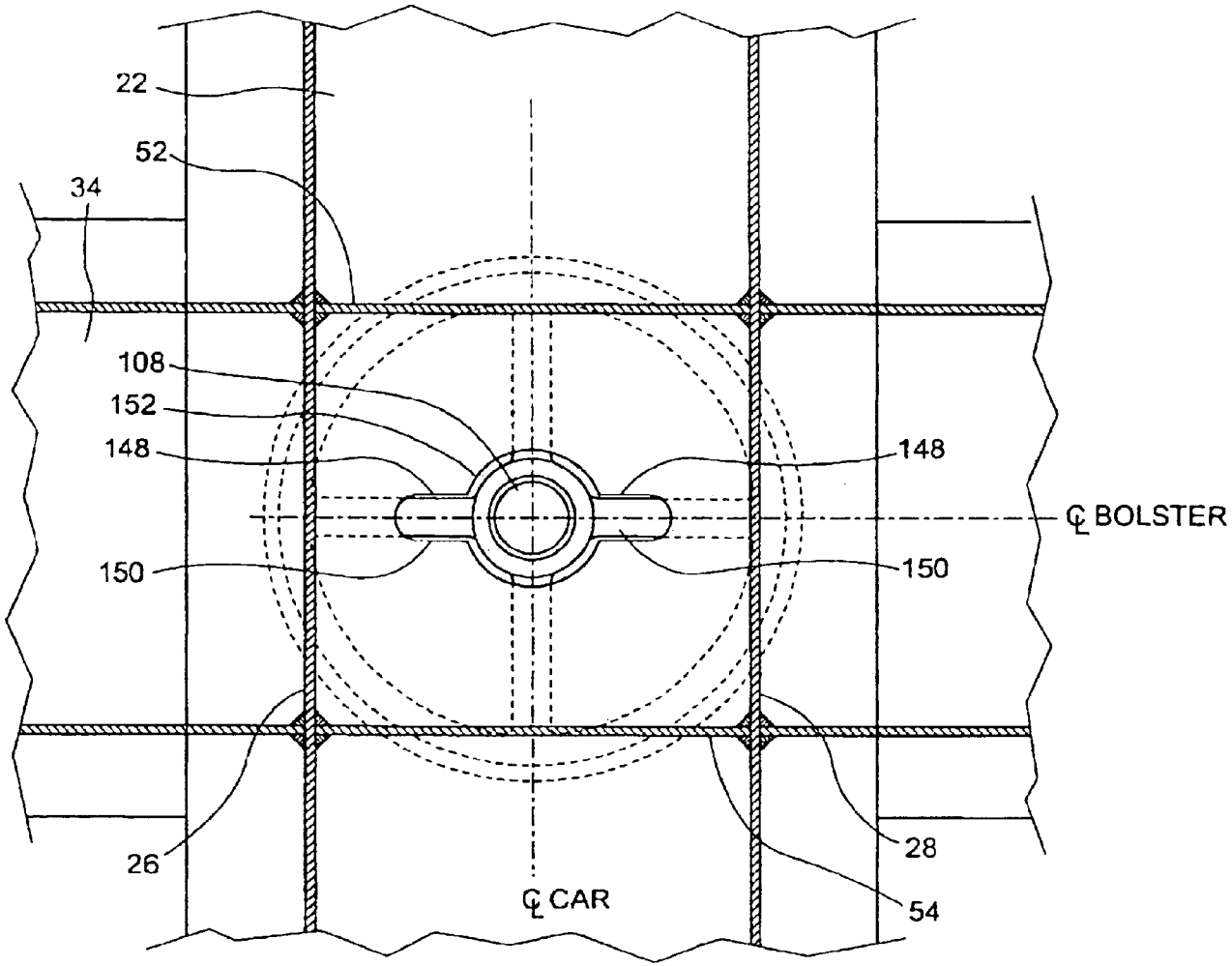
FIG. 2*b* is a top view of an alternate embodiment of center plate to that of FIG. 2*a;*

Considering FIGS. 2*a* and 2*b*, the center sill bottom cover plate 140 is provided with a keyed cut-out 142 in the nature of a vertical through bore 144 having radially extending elongate reliefs, such as might be termed notches, or slots, or guides, or indexing members, keyways, sockets, or female keying fittings, indicated as 146. Although two such keying fittings are shown, a single such fitting may be sufficient. The purpose of keying fittings 146 is to prevent canter plate 80 from being installed with reliefs 126 from being installed in a fore-and-aft orientation, but rather to encourage installation in the side to side manner. As illustrated, keying fittings 146 permit center plate 80 to be oriented in either of two equivalent orientations, 180 degrees of rotation apart. If a single keying fitting 146 were employed, only one such position, a unique position of engagement, (subject to suitable mating male engagement fitting on center plate 80) would be possible. On installation, the super elevated portion 134 of web 88 (or 90, as may be) acts as the male engagement fitting that engages the corresponding keying fitting 136, such that center plate 80 is located in a correct orientation relative to center sill 22.

FIG. 2*b* shows an alternate arrangement of keying features. In this case, the female keying features 148 are oriented in an east-west arrangement at the 3 o'clock and 9 o'clock positions, rather than in the 12 o'clock and 6 o'clock positions as in FIG. 2*a*. Male keying features 150 are similarly cast into the 3 o'clock and 9 o'clock positions on the webs of center plate 80, rather than on the 12 o'clock and 6 o'clock positions. In the embodiment of FIG. 2*b*, the longitudinal extent of the overall opening in the bottom cover plate of center sill 22 is thus equal to the circular diameter of the bore 152 provided to accommodate the truncated conical protrusion of truncated cone 84, this diameter, itself, being related to the king ping diameter. By contrast, the longitudinal extent of the opening in the embodiment of FIG. 2*a* is equal to that same diameter (of base 102), plus the addition of the length of the two female keying features 136.

FIGS. 2*a* and 2*b* both show the generally rectangular walled box periphery defined by the relationship of center sill webs 26, 28, and the center sill separators, namely internal cross-gussets 52, 54 that tend to give shear web continuity to the webs of main bolster 34 across center sill 22. The arc of the engagement interface of face 124 of center plate 80 with the underside of center sill cover plate 30 traverses the four sides of this rectangular shape 8 times, two times per side. The vertices of the box lie outside the interface, whereas the central portions of the four rectangular walls lie on, or just inside of, the circular engagement interface of face 129 of rim 98 with cover plate 30. As such, the great depth of webs 26, 28 and separators 52, 54 may tend to impose a high degrees of flatness on the center plate attachment interface, notwithstanding such residual stresses as may arise during the circumferential welding of center plate 80 to cover plate 30.

Figure 1C:
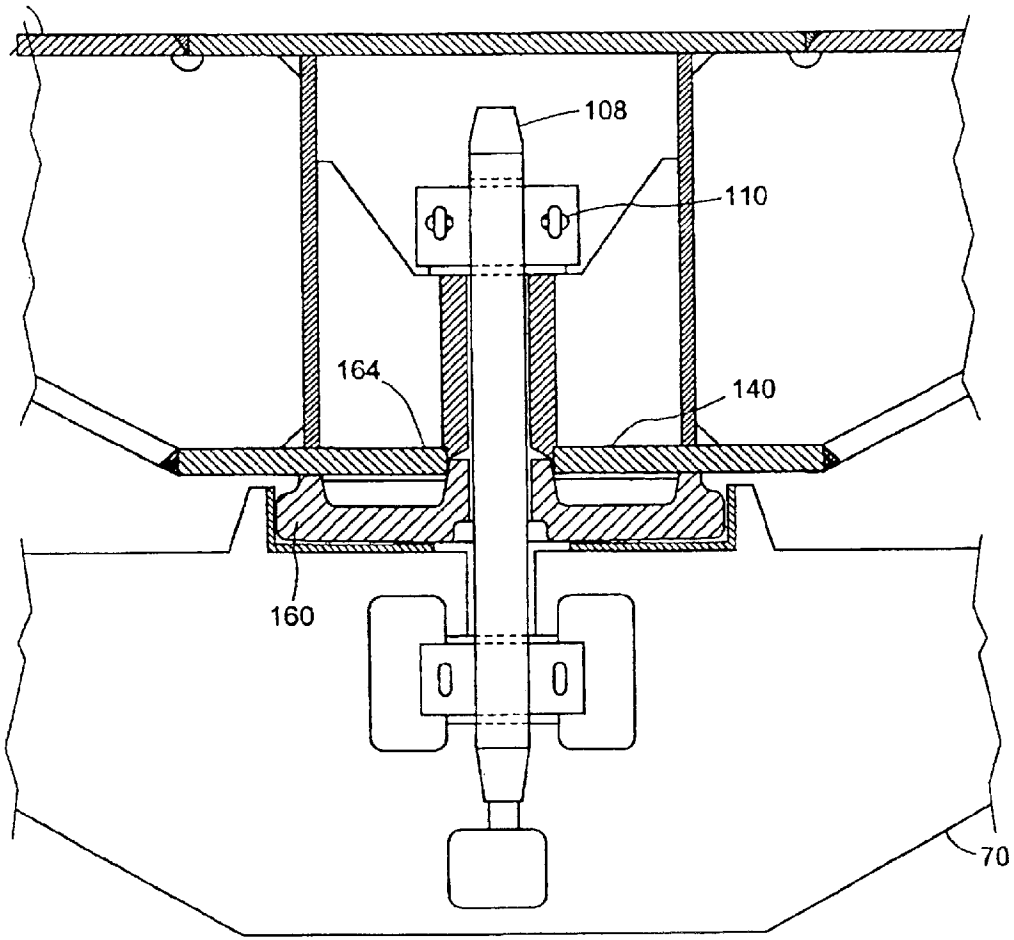
FIG. 1*c* shows an alternate embodiment of center plate installation to that of FIG. 1*a;*

The center plate of FIGS. 3*a*–3*e* may be employed in three circumstances. First, it may be employed during new construction, in which center plate 80 is welded to the bottom cover plate of the center sill, whether that center sill is fabricated or part of a cast center sill end section. In the second instance, center plate 80 may be used in place of the square plug style center plate, in which case it may also be employed with a tie plate or a saddle plate such as 156 of FIG. 4 having an opening 162 to suit the super-elevated keying features. In the third instance it may be used in a retro-fit installation to replace center plates of the style shown in FIG. 1*b*, and, in particular, to replace bolted center plates that have experienced cracking, whether at the bolts or elsewhere. In that case, it may be desirable not to have to remove the existing internal center filler materials. For that purpose, as shown in the embodiment of FIG. 1*c*, a short boss center plate 160 is employed. Center plate 160 is substantially the same as center plate 80, except that truncated cone 164 is shorter than truncated cone 84, to permit the existing collar and center filler gusset plates to remain in place. Once again, a new cover plate 166 is welded into the center sill, and center plate 160 is welding in place by the same circumferential welding technique as described above. Truncated cone 164 has an upper extremity and keying features that protrude vertically beyond the horizontal planar interface of rim 168 with cover plate 166 to a depth approximately equal to the though thickness of cover plate 166. While it is preferable that cover plate 166 be mounted flush with the outboard flange portions of the center sill 22, this is not strictly necessary if cover plate 166 is mounted to provide flange continuity, typically be being thicker than those adjoining flanges, and overlapping them in thickness.

Figure 1D:
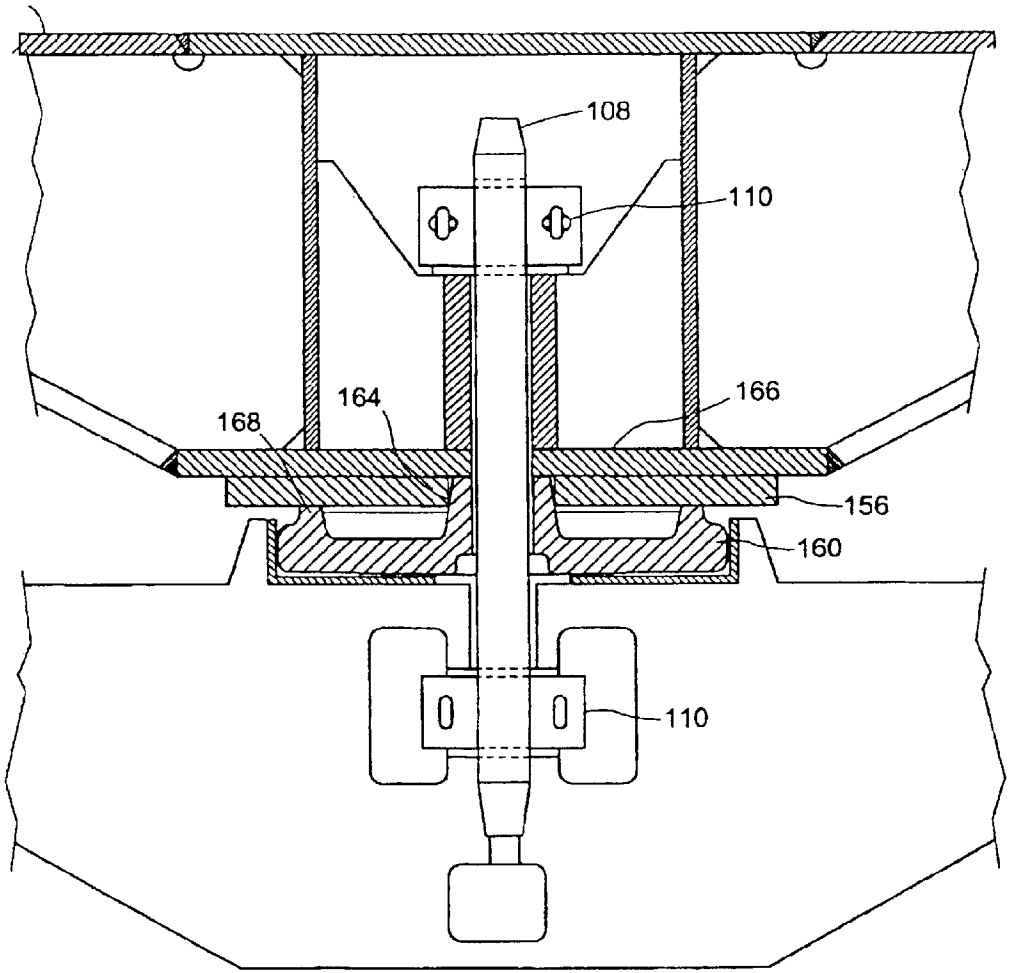
FIG. 1*d* shows a further alternate embodiment of center plate installation to that of FIG. 1*a;*

In the further alternative of FIG. 1*d*, it may be desired to maintain the same coupler height as formerly, or it may be desired not to cut a female engagement fitting into an existing center filler and bottom cover plate. In that case, center plate 160 may be provided in a kit with a saddle plate, such as saddle plate 156. Saddle plate 156 has a pre-cut female keying fitting, and is welded in place directly under the existing center filler and cover plate, with the thickness of saddle plate 156 being substantially the same as the thickness of the former base plate A52, such as might have been 5⁄16" to 1 1⁄16" thick. In the case of replacement or substitution of a plug style center plate casting, the plate thickness of saddle plate 156 may be in the range of 13⁄16" to 1 1⁄16, the 13⁄16" depth being suitable when replacing a 3 5⁄16" deep center plate, and the 1 1⁄16" deep center plate being suitable when replacing a 3 9⁄16" deep center plate.

In the preferred embodiment, the spacing of webs 26, 28 of center sill 22 is 12 7⁄8", (+1⁄8", −0") measured across the inside faces. Similarly, in the preferred embodiment the spacing of internal gusset webs is 12 inches between centers, to align them with the spacing of webs 44, 46 of main bolster 34.

Figure 3A:
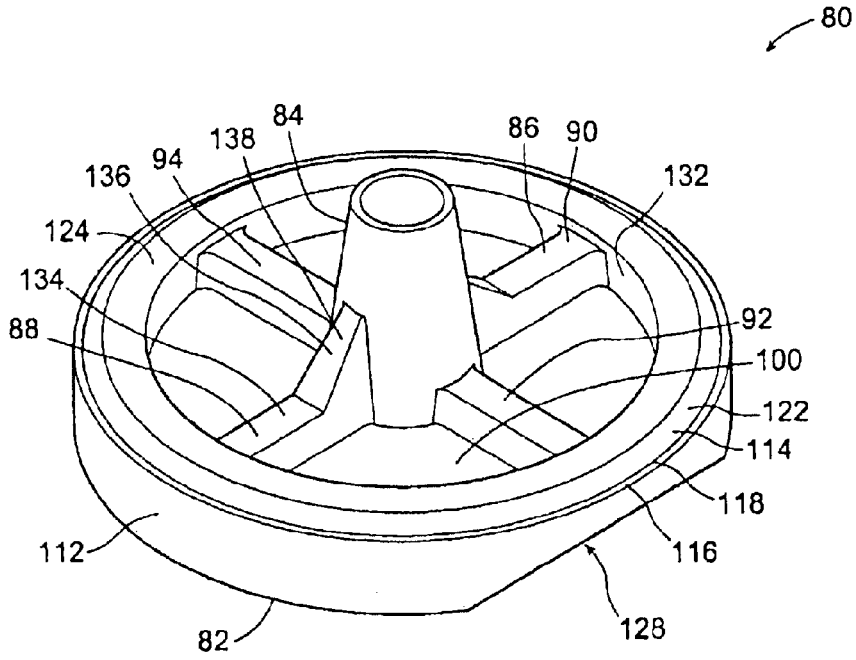
FIG. 3*a* shows an isometric view of the center plate of FIG. 1*a;*
Figure 3E:
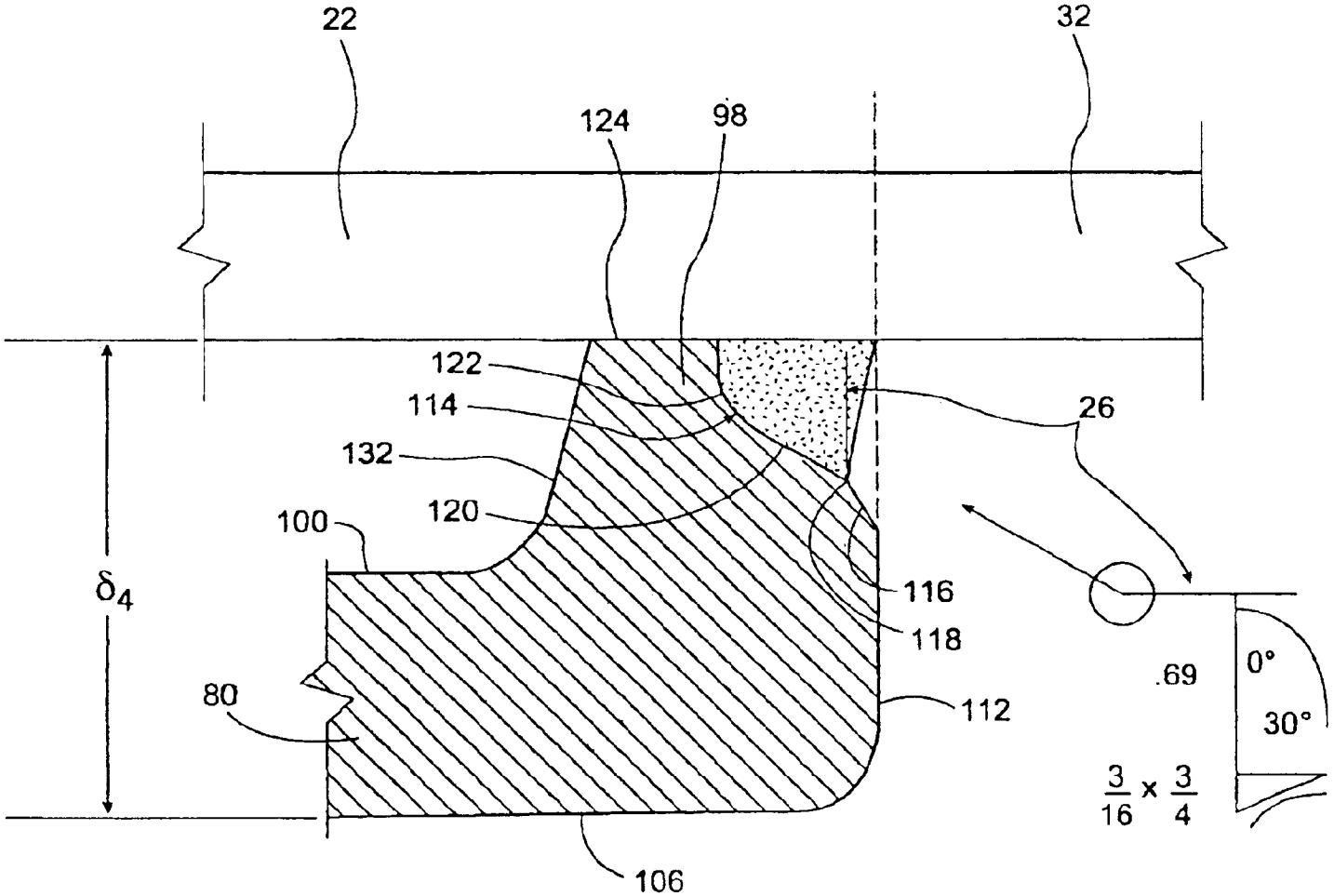
FIG. 3*e* shows a welding detail of the center plate of FIG. 3*a*.
Figure 4:
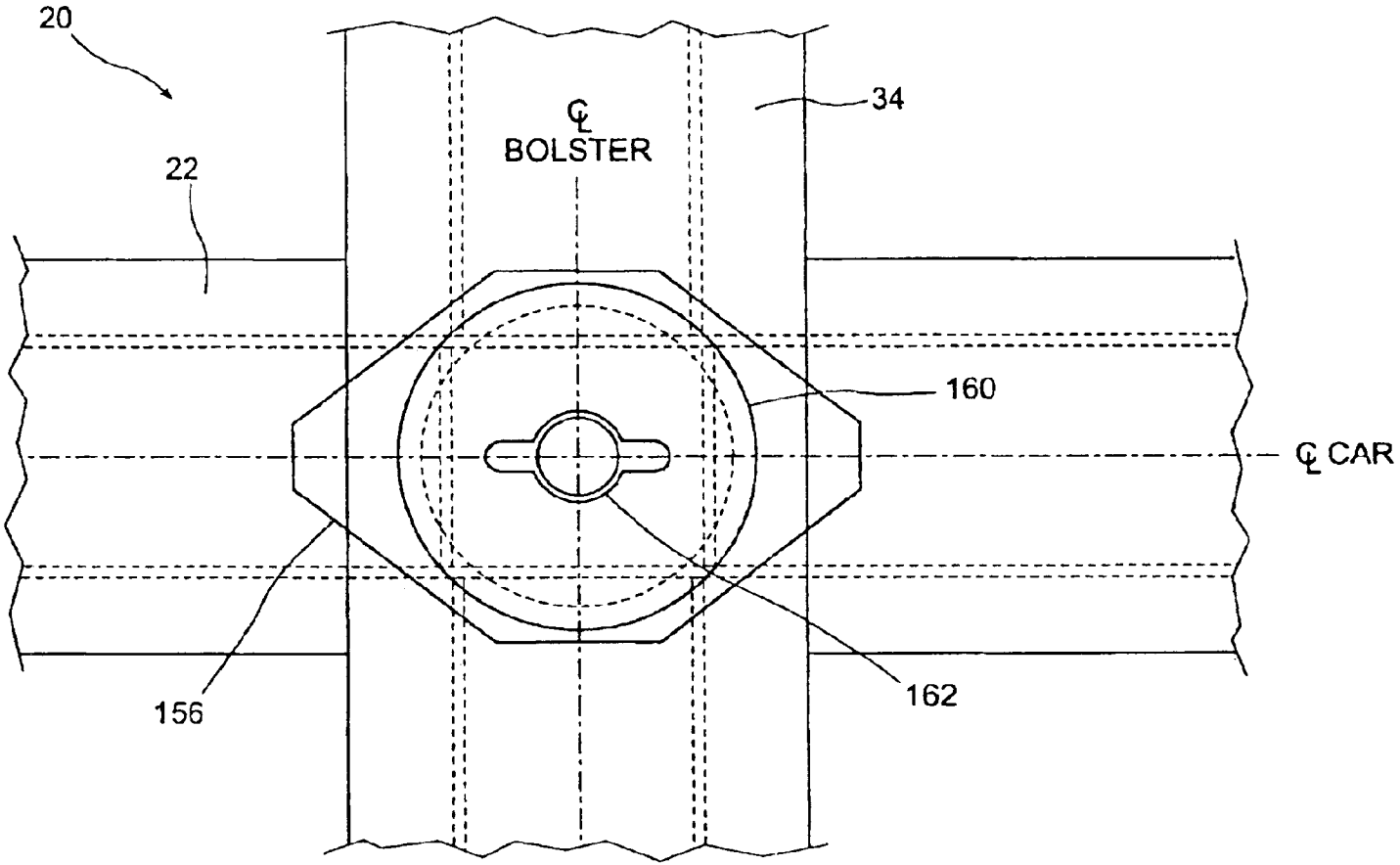
FIG. 4 shows a view of the location of a saddle plate for use with the center plate of FIG. 1*d*.

As compared to plug style center plates, the center plate of FIG. 3*a* may provide a weight saving of about 300 lbs per rail road car, or roughly 150 lbs per center plate. The overall weight of the center plate of FIG. 3*a* may be less than 150 lbs., and may, for a nominal 16" center plate such as may be used with a 100 Ton truck, or larger, may be in the range of as little as 120–130 lbs, or may be less then 120 lbs.

While it is preferred that the web separator plates of the center sill be centrally aligned with the main bolster webs, they can be considered to be acceptably directly aligned in some circumstances even when not precisely centrally aligned. That is, the webs can be considered to be acceptably directly aligned if either (a) the central plane of the web separator is in line with, or overlapped by, an edge of the corresponding main bolster web, or (b) the centerline of the main bolster web is in line with, or overlapped by, the web separator, such that the thinner of the two is at least half-overlapped by the thicker one. It is advantageous that the webs not be offset from each other by more than half the thickness of either the main bolster web or the web separator.

In the installations shown and described herein, the edge preparation of the weld may tend to be simplified relative to the plug style center plate connection. As described above, the present large square opening in the bottom of the center sill is not required (or desired). Subject to the relatively small opening for the king pin and mis-orientation deterring features, the center sill bottom cover plate remains in place. The required welding is a preferably a continuous "J" fillet weld that extends around the circumference of the round center plate rim. There may no longer tend to be a change in welding direction, or a stop-and-start of the weld, which may tend to reduce the incidence of crack formation in the weld. Accessibility to the entire 360 degree weld may tend to be unobstructed, and may, therefore, be suitable for the step of automated welding. The edge 118 provides an all around weld termination datum. The round design of the center plate shown an described herein may tend to be simpler than a square part, may be easier to cast, and may be easier to machine, and may lead to resultant cost savings.

Although the rim of the center plate is desirably short, as might most typically be desirable in newly constructed cars, (thus permitting either a general lowering of the center of gravity of the car of a deeper center sill), the rim can be made of such other, taller height as may be desired to suit an existing design or retro-fit installation.

In the case of an existing railway car of the style having a bolted center plate, such as may require center plate replacement because of worn out plates, or because of broken center plate mounting bolts, due to lack of flatness of the center sill bottom cover plate, may tend more easily to have these plates replaced with a center plate according to one of the embodiments described herein, such as the embodiment of FIG. 1*c* or 1*d*, having a shallower locking center pin housing (namely the hollow upstanding central portion of the casting that stands proud of the height of the surrounding flat abutment face of the rim). In this kind of replacement installation, the method of replacement may include the step of removing the existing center plate. The center plate aperture is prepared, typically by cutting (i.e., burning) a hole of suitable shape and size with a torch through the center sill bottom cover plate (or through the bolster bottom tie plate, if present). The center plate may be inserted. The center plate may then be welded in place about the circumferential rebate. In the case of a retro-fit installation where a low profile, plug style center plate had been used, the method of retro-fit installation includes the step of applying a saddle plate to straddle the present square opening, with or without an internal cover plate welded flush with the bottom center sill, followed by the step of welding the saddle plate in place. The saddle plate may have been pre-prepared with a central aperture and keying feature, or features. Once the saddle plate is in place with the appropriate central opening, the center plate is welded in place as before.

Various embodiments of the invention have now been described in detail. Since changes in and or additions to the above-described best mode may be made without departing from the nature, spirit or scope of the invention, the invention is not to be limited to those details, but only by the appended claims.

I claim:

1. A center plate for a railroad car, the center plate having an upwardly oriented mounting interface for rigid connection to the railroad car, a radially farthest portion of the center plate within a center plate bowl of the railroad car truck, a downwardly facing bearing surface mountable in pivotable engagement within the center plate bowl, and a central portion sized to engagingly fit a king pin, the central portion standing taller than said mounting interface, said central portion and said radially farthest portion being parts of a monolith.

2. The center plate of claim 1 wherein said center plate is a monolith.

3. The center plate of claim 1 wherein said center plate is a casting.

4. The center plate of claim 1 wherein said radially farthest portion is an upstanding peripheral wall.

5. The center plate of claim 4 wherein said upstanding peripheral wall is circular.

6. The center plate of claim 1 wherein a welding relief is formed radially outwardly adjacent to said upwardly oriented mounting interface.

7. The center plate of claim 4 wherein a welding said upwardly oriented interface includes an upwardly oriented abutment face, and relief is formed radially outwardly adjacent to said abutment face.

8. The center plate of claim 1 wherein said center plate has an upwardly oriented indexing member operable to discourage mis-orientation of said center plate relative to the railroad car.

9. A center plate for a railroad car, wherein the center plate has:

an upwardly oriented mounting interface for rigid connection to the railroad car;

a radially farthest portion of the center plate seatable within a center plate bowl of the railroad car truck;

a downwardly facing bearing surface mountable in pivotable engagement within the center plate bowl;

a central portion sized to engagingly fit a king pin, the central portion standing taller than said mounting interface;

a base plate, said bearing surface being a surface of said base plate;

a circular peripheral wall, said radially farthest portion being a radially outwardly oriented portion of said circular peripheral wall;

said circular peripheral wall extending upwardly of said base plate;

at least one web standing upwardly of said base plate and extending between said central portion and said circular peripheral wall; and an indexing member, said indexing member being a super-elevated portion of said web.

10. A center plate in the form of a casting for a railroad car, the casting having a radially farthest portion of the center plate surrounding a bearing surface, said radially farthest portion being seatable entirely radially within a center plate bowl of a railcar truck, said radially farthest portion having an upwardly oriented abutment for rigid connection to the railroad car, said bearing surface being placed upon a railcar truck and a hollow central portion sized to engagingly fit a king pin and standing taller than said abutment.

11. A center plate in the form of a casting for a railroad car, the casting having a bearing portion for seating in pivotally movable engagement within a center plate bowl of a railroad car truck;

an interface for rigidly mounting to a railroad car;

a radially farthest portion of the center plate seatable within a center plate bowl a hollow sized to engagingly fit a king pin and standing taller than, and radially inward of, the interface; and the casting being free of any member extending a radially greater distance than said radially farthest portion.

12. A center plate for a railroad freight car, the center plate being for installation between a central sill member of the rail road car and a center plate bowl of a railroad car truck, said center plate comprising:

a base portion having a bearing surface pivotally engageable in the center plate bowl of the truck;

a peripheral wall extending upwardly of said bearing surface, said wall having an attachment interface for rigid mounting of said center plate to the central sill member of the railroad car; and a central hollow member standing upwardly of said base portion;

said hollow central member, and said peripheral wall being portions of a monolith;

said hollow member being taller than said peripheral wall;

said hollow member having a passage defined therein to engagingly fit a railroad car king pin; and said center plate being free of any member extending radially beyond said peripheral wall.

13. The center plate of claim 12 wherein said center plate has at least one indexing member engageable with said central sill member to establish angular orientation of said center plate relative to said central sill member.

14. The center plate of claim 12 wherein said peripheral wall has a welding relief extending thereabout adjacent to said attachment interface.

15. The center plate of claim 12 wherein upstanding web members extend between said central hollow member and said peripheral wall.

16. The center plate of claim 13 wherein upstanding web members extend between said central hollow member and said peripheral wall, and said indexing member is a super-elevated portion of one of said web members.

17. The center plate of claim 12 wherein said center plate is a monolith.

18. The center plate of claim 12 wherein said center plate is a casting.

19. The center plate of claim 12 wherein said peripheral wall is a circular wall extending about said base portion.

20. The combination of a railroad car and a railroad car truck therefore wherein:

the railroad car has a center plate mounted thereto;

the truck has a center plate bowl having a receiving recess into which the center plate seats in pivotally moveable engagement;

said center plate having a connection portion by which it is rigidly attached to said railroad car;

said center plate having a radially inward portion sized to engagingly fit a king pin;

said connection portion and said radially inward portion bein parts of a monolith;

said radially inward portion standing taller than said connection portion; and said center plate being free of any portion overhanging the receiving recess of said center plate bowl.

* * * * *